US005266048A

United States Patent [19]

Brekosky et al.

[11] Patent Number: 5,266,048

[45] Date of Patent: Nov. 30, 1993

[54] GULL-WING STRAIN RELIEF

[75] Inventors: Lawrence J. Brekosky, Etters; David L. Meyer, Jonestown, both of Pa.

[73] Assignee: The Whitaker Corporation, Wilmington, Del.

[21] Appl. No.: 37,772

[22] Filed: Mar. 26, 1993

[51] Int. Cl.[5] ..... H01R 13/58

[52] U.S. Cl. ..... 439/470; 439/459; 439/492

[58] Field of Search ..... 439/470, 471, 67, 77, 439/404, 405, 456, 459, 492, 498, 499

[56] References Cited

U.S. PATENT DOCUMENTS

| | | | |
|---|---|---|---|
| 3,355,699 | 11/1967 | Oshva | 439/492 |
| 3,879,099 | 4/1975 | Shaffer | 339/99 R |
| 4,196,956 | 4/1980 | Hoffman | 439/404 |
| 4,225,205 | 9/1980 | Sinclair et al. | 339/59 M |
| 4,278,314 | 7/1981 | Moser et al. | 439/404 |
| 4,804,342 | 2/1989 | Rudy, Jr. et al. | 439/467 |
| 4,898,543 | 2/1990 | Benze | 439/374 |
| 4,921,441 | 5/1990 | Sauder | 439/460 |
| 4,925,401 | 5/1990 | Fogg et al. | 439/404 |
| 5,011,430 | 4/1991 | Haitmanek | 439/456 |

*Primary Examiner*—Larry I. Schwartz
*Assistant Examiner*—Hien D. Vu

[57] ABSTRACT

A gull-wing strain relief (10) for a flat multi-conductor ribbon cable (30) exiting a connector assembly (20). The gull-wing strain relief (10) is mounted directly on the connector assembly (20) and includes lateral flaps (14) which close around the connector assembly (20). The flaps (14) may be interlocked in a fully closed position wherein the ribbon cable (30) exiting the connector assembly (20) is held in compression to thereby protect against strain from twisting or pulling.

13 Claims, 4 Drawing Sheets

GULL-WING STRAIN RELIEF

FIELD OF THE INVENTION

The present invention relates to electrical connectors and, more particularly, to a strain relief for protecting flat multi-conductor ribbon cables exiting a connector assembly.

BACKGROUND OF THE INVENTION

Conventional strain relief devices for electrical cables clamp the cables against the connector housing and/or other adjacent cables down line from the delicate terminations made within the connector. This way, strain on the cable is diverted to the connector housing before reaching the terminations. This minimizes the stress imposed on the terminations within the connector and thereby prevents faulty electrical contact and breakage.

Effective strain relief of ribbon cables is a more demanding task due to the nature of the connector and the large number of conductors typically existing in a ribbon cable. Ribbon cables may include hundreds of side-by-side conductors joined by a ribbon binder. Such cables are typically terminated in single or multiple rows of insulation displacing contact terminals seated within narrow elongate connector housings. The ribbon cable is pressed in place against the contact terminals, and the terminals pierce the insulating binder to make contact with the conductors therein. The resulting compression-type terminations are prone to strain when the cables are pulled or twisted. Consequently, it is essential to incorporate some form of strain relief in the connector assembly to protect the terminations.

For example, U.S. Pat. No. 5,011,430 issued to Haitmanek shows an electrical connector assembly for terminating a flat multi-conductor ribbon cable. The connector assembly includes an elongate housing in which a plurality of insulation displacing contacts is arrayed. Strain relief is provided to the portions of the cable exiting the connector by spring clips that clamp the cable against a side wall of the housing. Unfortunately, the Haitmanek '430 strain relief is integral to a particular connector assembly and cannot be retrofit to an existing connector. Moreover, metal spring clips are required. These clips are difficult to manufacture, and special tooling is required for assembly.

U.S. Pat. No. 4,255,205 issued to Sinclair et al. discloses a ribbon cable connector with two pivoting flaps which clamp the ribbon cable therebetween. Strain relief is provided by a plurality of posts which penetrates the binder down line of the terminations and by protruding ribs which are compressed against the ribbon cable. The Sinclair et al. '205 connector is easy to apply and such may be accomplished manually. However, the Sinclair et al. '205 strain relief is still integral to the particular connector assembly and cannot be retrofit to an existing connector.

U.S. Pat. No. 3,879,099 issued to Shaffer discloses a ribbon cable connector with pivoting flaps which bias the insulation displacing contacts against the ribbon cable, thereby completing the terminations. In addition, the flaps protrude beyond the contacts and interlock down line therefrom to provide a measure of strain relief. Again, the Shaffer '099 strain relief is integral to the particular connector assembly and cannot be retrofit to an existing connector.

SUMMARY OF THE INVENTION

It is, therefore, an object of the present invention to provide a strain relief for a ribbon cable connector assembly. It is a further object of the present invention to provide a cable strain relief device as described above which can be retrofit to an existing ribbon cable connector.

It is still another objective of the present invention to provide a strain relief assembly which has few parts and is capable of simple manual assembly.

In accordance with the above-described and other objects, the present invention provides an improved stain relief for a ribbon cable connector. The strain relief is designed for attachment to an elongate connector housing having an array of contact terminals seated therein. As in conventional ribbon cable connectors, one end of the contact terminals is formed as a terminal pin, and this end protrudes into a hood portion of the connector housing for interfacing a mating connector assembly. The other ends of the contact terminals are formed as insulation displacing plates, and these protrude into a terminating portion of the connector housing for terminating the ribbon cable. According to the invention, the terminating portion is broader than the hood portion and is integrally joined thereto at a surrounding lip.

A unitary gull-wing strain relief is provided, and this may be secured around the hood portion (without special fasteners or tooling). The strain relief includes an elongate collar conforming to the hood portion of the connector housing and insertable thereon for seating the strain relief on the lip. A pair of elongate gull-wing flaps is formed integrally to the collar, and the pair is pivotally joined thereto along compliant seams. The flaps extend from opposite sides of the connector housing and are angled inward at a bend formed along their length. The flaps extend past the respective bends to engagable interlocking edges.

In operation, the gull-wing flaps may be pivoted around the terminating portion of the connector housing and interlocked at the edges thereby compressing the ribbon cable therebetween. The strain relief serves to enclose the terminating portion of the connector housing and absorb stresses and strains imparted to the ribbon cable.

Other advantages and results of the invention are apparent from a following detailed description by way of example of the invention and from the accompanying drawings.

BRIEF DESCRIPTION OF DRAWINGS

FIG. 1 shows the unassembled and fully-opened strain relief 10 and ribbon cable connector assembly 20.

FIG. 2 shows the assembled strain relief 10 and ribbon cable connector assembly 20 with the gull-wing flaps 14 in a partially-closed position.

FIG. 3 shows the fully assembled and closed strain relief 10 on the ribbon cable connector assembly 20.

DETAILED DESCRIPTION OF THE PREFERRED EMBODIMENT

Figure 1:
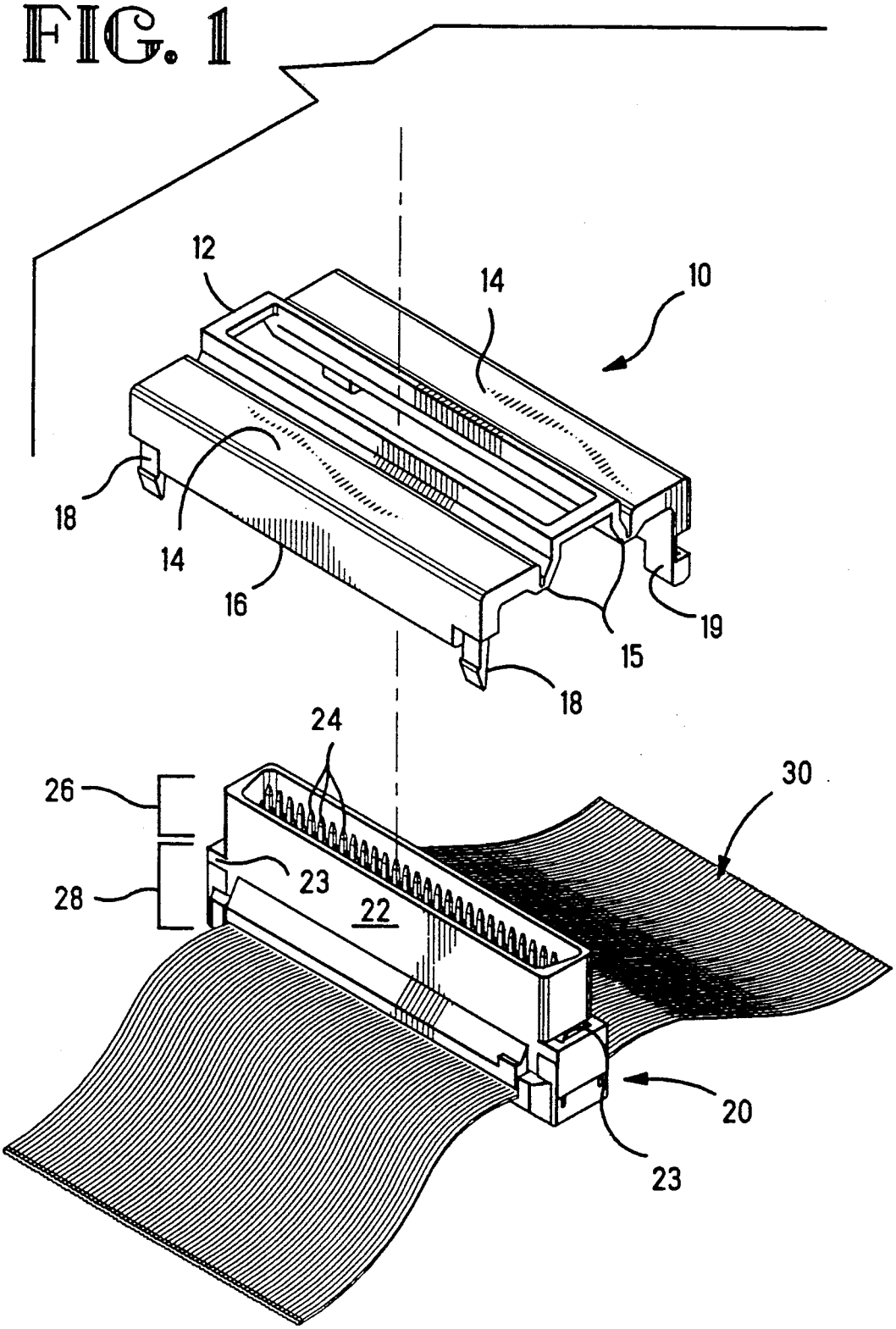
FIGS. 1-3 are sequential perspective views illustrating the assembly and operation of a gull-wing strain relief 10 and ribbon cable connector assembly 20 according to the present invention.
Figure 2:
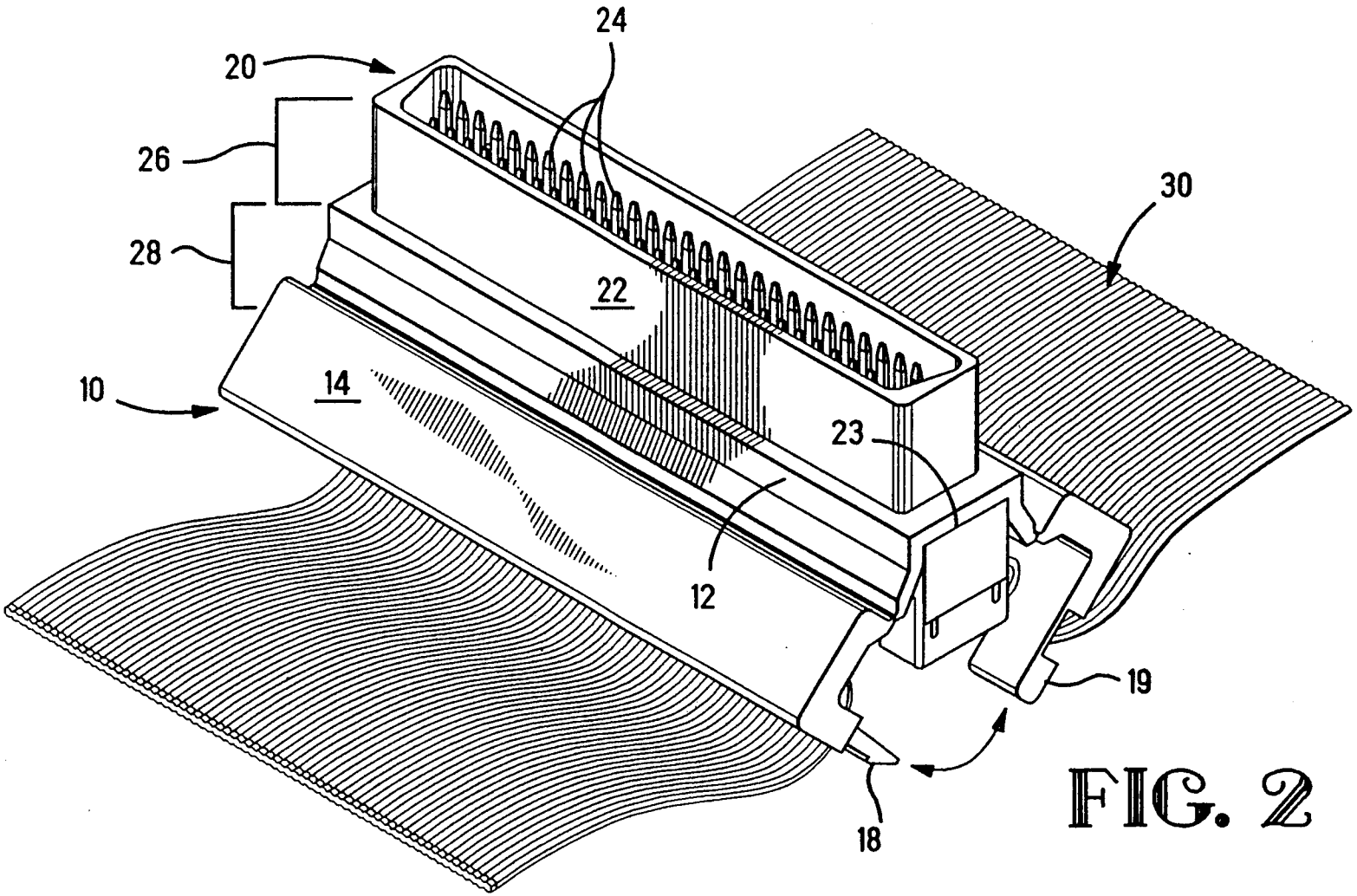
Figure 3:
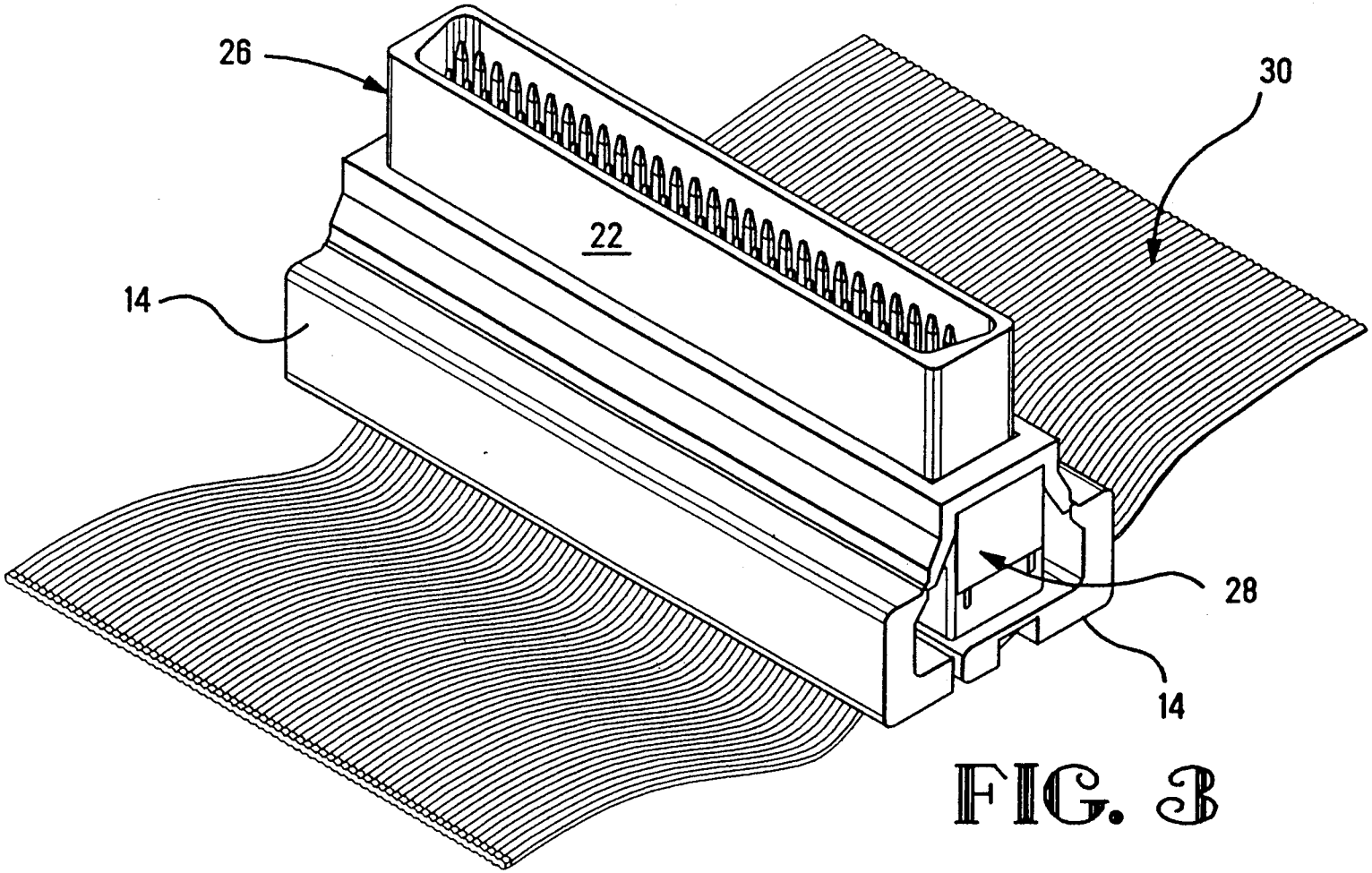

With more particular reference to the drawings, FIGS. 1-3 are sequential views illustrating the assembly and operation of a gull-wing strain relief 10 and ribbon cable connector assembly 20 according to the present invention.

As shown in FIG. 1, the ribbon cable connector assembly 20 of the present invention includes an elongate connector housing 22 having an array of contact terminals 24 seated therein. The exposed ends of the contact terminals 24 are formed as terminal pins, and the terminal pins protrude into a hood portion 26 of the connector housing 22. The hood portion 26 and terminal pins are adapted to interface a mating connector assembly (not shown).

The downwardly protruding ends of the contact terminals 24 are formed as insulation displacing plates, and these are enclosed within a portion 28 of the connector housing that is dedicated to terminating ribbon cable 30.

The illustrated ribbon cable 30 is a conventional flat conductor cable which incorporates a plurality of round conductors, either of standard or solid wire, disposed in a parallel side-by-side array and maintained by a binder of insulating material. However, it should be understood that the subject invention may also be employed with connectors for other forms of flat cables.

In accordance with the invention, the terminating portion 28 of the connector housing 22 is broader than the hood portion 26 in selected respects. For instance, as shown, the terminating portion 28 is longer than the hood portion 26. As a result, the juncture of the terminating portion 28 to the hood portion 26 creates a pair of lips 23 at the ends of the connector housing 22. Of course, the terminating portion 28 may be broader than the hood portion 26 in other respects to accomplish the intended purpose. For instance, the terminating portion 28 may be wider than the hood portion 26 to create a pair of front and rear lips (not shown) in addition to or in lieu of lips 23. In total, there may be a continuous rectangular lip surrounding the connector housing 22.

In any case, a unitary gull-wing strain relief 10 is provided in accordance with the present invention. The strain relief 10 may be integrally molded from insulating plastic or the like. Strain relief 10 is formed with an elongate rectangular collar section 12 having a central aperture which conforms to the periphery of the hood portion 26 of connector housing 22. The elongate sides of collar 12 are pivotally joined to a pair of elongate gull-wing flaps 14. Flaps 14 are preferably formed integrally with collar 12 and are joined thereto at a pair of compliant seams 15 formed in the plastic.

Flaps 14 are shown in an open position in FIG. 1, and in the open position flaps 14 extend from opposite sides of the connector housing 22. The flaps 14 extend outward by a distance slightly exceeding the height of the terminating portion 28 of the connector housing 22. Flaps 14 are then angled downward at a substantially right angle and continue to extend beyond the respective angles to a pair of engagable interlocking edges 16. The edges 16 are blunted along a portion of their length to allow compression of the binder of ribbon cable 30 without rupturing the material.

The edges 16 of flaps 14 are also formed with a series of cooperating latches spaced lengthwise to releasibly lock the flaps 14 in a closed position with the ribbon cable 30 compressed in between. In the illustrated embodiment, the latches further comprise two resilient prongs 18 protruding outward from the ends of one edge 16 and two couplings 19 protruding outward from the ends of the opposing edge.

Prongs 18 are each provided with a flared tip which is truncated to form a latching lip. The couplings 19 are each positioned adjacent a corresponding prong 18 and confront said prongs 18 with an aperture for receipt thereof.

Assembly of the strain relief 10 to the connector assembly 20 is simple and may be accomplished manually without special fasteners or tooling.

As shown in FIG. 2, the strain relief 10 is mounted by collar 12 around the hood portion 26 of connector assembly 20. The collar 12 is inserted until it abuts the lips 23 formed at the junction of the hood portion 26 and terminating portion 28 of connector housing 22. At this point, the strain relief 10 is securely seated on connector assembly 20 with gull-wing flaps 14 in a fully opened position.

As shown in FIG. 3, the flaps 14 may be pivoted to enclose the terminating portion 28 of connector assembly 20 and effect strain relief of ribbon cable 30.

Figure 4:
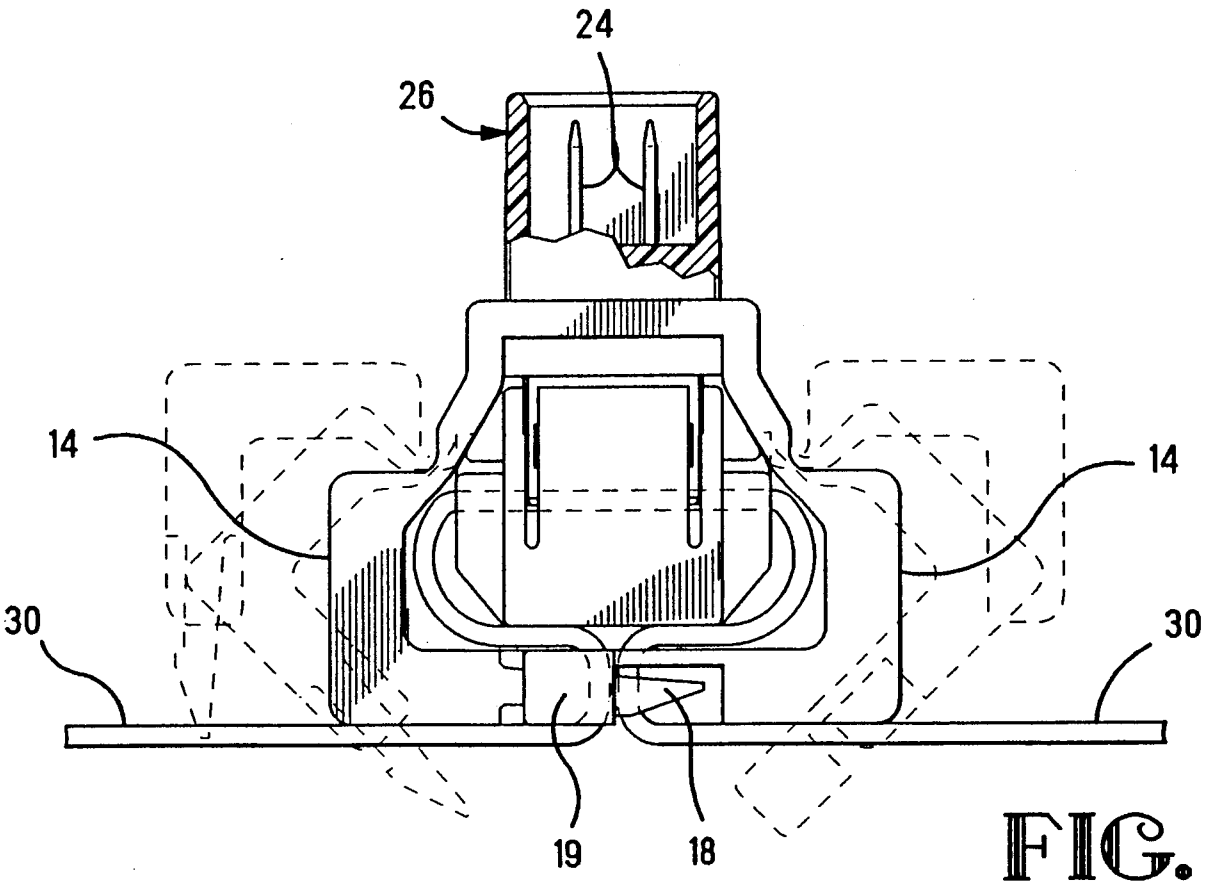
FIG. 4 is a side cross-sectional view of the closed strain relief 10 on the connector assembly 20 as in FIG. 3, with the sequence steps of FIGS. 1 and 2 indicated by dotted lines.

The operation of the strain relief 10 is better seen in FIG. 4, which illustrates a side cross-section of the closed strain relief 10 on connector assembly 20 as in FIG. 3, with the sequence steps of FIGS. 1 and 2 shown in dotted lines.

The ribbon cable 30 enters the terminating portion 28 of connector assembly 20 transversely, and the downwardly protruding insulation displacing plates of contact terminals 24 complete electrical contact with the appropriate conductors of the ribbon cable 30.

The gull-wing flaps 14 of strain relief 10 are pivoted downwardly from the fully-opened position of FIG. 1, and the sections of ribbon cable 30 extending on both sides of the connector assembly 20 are engaged by the blunted edges 16 of flaps 14. Continued pivoting of flaps 14 biases the ribbon cable 30 inward beneath the connector housing 22. As the flaps 14 of strain relief 10 are pivoted to a fully-closed position, the respective sections of ribbon cable 30 are compressed together to form a loop through the terminating portion 28 and underneath.

The resilient prongs 18 along the edges 16 of flaps 14 are received in the apertures of couplings 19, and the couplings 19 ride upon the flared tips of prongs 18 until clearing the respective lips. Prongs 18 are then captured within couplings 19, and the edges 16 of flaps 14 become interlocked with the two sections of ribbon cable 30 compressed together therebetween.

Strains imparted to cable 30 are diverted at the compressive engagement of the edges 16 of gull-wing flaps 14 to the connector housing 22. In addition, the strain relief 10 of the present invention fully encloses the cable terminating portion 28 of the connector assembly 20 and prevents the invasion of dust and debris. Consequently, the multiple cable terminations occurring within terminating portion 28 are well-protected.

Having now fully set forth a detailed example and certain modifications incorporating the concept underlying the present invention, various other modifications will obviously occur to those skilled in the art upon becoming familiar with said underlying concept. It is to be understood, therefore, that within the scope of the appended claims, the invention may be practiced otherwise than as specifically set forth herein.

We claim:

1. A strain relief for a ribbon cable connector comprising an elongate connector housing having an array of contact terminals seated therein, one end of said contact terminals comprising terminal pins protruding into a hood portion of said connector housing for interfacing a mating connector assembly, and another end of said contact terminals comprising insulation displacing plates protruding into a terminating portion of said connector housing for terminating a ribbon cable, said strain relief comprising:

an elongate collar conforming to the hood portion of said connector housing and insertable thereon for seating said strain relief on said connector assembly; and a pair of elongate gull-wing flaps formed integral to said collar and pivotally joined thereto along compliant seams, said flaps extending on opposite sides of said connector housing and angling inward to engagable interlocking edges;

whereby said gull-wing flaps may be pivoted around the terminating portion of said connector housing and interlocked at said edges with said ribbon cable compressed therebetween to thereby enclose said terminating portion and absorb strain imparted to said ribbon cable.

2. The strain relief according to claim 1 wherein said gull-wing flaps diverge from opposite sides of said connector housing while in an open position and angle inwardly to cover said terminating portion of the connector housing when pivoted into a closed position.

3. The strain relief according to claim 2 wherein said gull-wing flaps are formed with right angles along their lengths.

4. The strain relief according to claim 1 wherein the engagable edges of said gull-wing flaps each further comprise an elongate blunt edge for compressing said ribbon cable.

5. The strain relief according to claim 4 wherein said gull-wing flaps are formed with cooperating latches spaced along said blunt edges for locking said flaps into engagement with said ribbon cable compressed therebetween.

6. The strain relief according to claim 5 wherein said latches further comprise a plurality of resilient prongs protruding from the engagable edge of one of said flaps, said prongs having a truncated flared tip, and a plurality of couplings protruding from the engagable edge of the other of said flaps, said prongs being aligned with said couplings for insertion therein when said gull-wing flaps are pivoted into a closed position, whereby said couplings capture said prongs by their flared tips to lock said flaps in engagement.

7. A ribbon cable connector comprising:

an elongate connector housing having a hood portion at one end for interfacing a mating connector assembly, and a terminating portion at another end for terminating a ribbon cable, said hood portion intersecting said terminating portion at a lip;

an array of contact terminals seated in said connector housing, one end of said contact terminals comprising terminal pins protruding into said hood portion of said connector housing, and another end of said contact terminals comprising insulation displacing plates protruding into said terminating portion; and a unitary gull-wing strain relief including an elongate collar conforming to the hood portion of said connector housing and insertable thereon for seating said strain relief on said lip, a pair of elongate gull-wing flaps integral to said collar and pivotally joined thereto along compliant seams, said flaps extending from opposite sides of said connector housing and angling inward to engagable interlocking edges;

whereby said gull-wing flaps of said strain relief may be pivoted around the terminating portion of said connector housing and interlocked by said edges with said ribbon cable compressed therebetween to thereby enclose said terminating portion and protect against strain imparted to said ribbon cable.

8. The ribbon cable connector according to claim 7 wherein said gull-wing flaps diverge from opposite sides of said connector housing while in an open position and angle inwardly to cover said terminating portion of the connector housing when pivoted into a closed position.

9. The ribbon cable connector according to claim 8 wherein said gull-wing flaps are formed with convergent right angles along their lengths.

10. The ribbon cable connector according to claim 7 wherein the engagable edges of said gull-wing flaps each further comprise an elongate blunt edge for compressing said ribbon cable.

11. The ribbon cable connector according to claim 10 wherein said gull-wing flaps are formed with cooperating latches spaced along said blunt edges for locking said flaps into engagement with said ribbon cable compressed therebetween.

12. The ribbon cable connector according to claim 11 wherein said latches further comprise a plurality of resilient prongs protruding from the engagable edge of one of said flaps, said prongs having a truncated flared tip, and a plurality of couplings protruding from the engagable edge of the other of said flaps, said prongs being aligned with said couplings for insertion therein when said gull-wing flaps are pivoted into a closed position, whereby said couplings capture said prongs by their flared tips to lock said flaps in engagement.

13. A ribbon cable connector comprising:

an elongate connector housing having a rectangular hood portion at one end for interfacing a mating connector assembly, and a broader rectangular terminating portion at another end for terminating a ribbon cable, said hood portion intersecting the broader terminating portion at a lip;

an array of contact terminals seated in said connector housing, one end of said contact terminals comprising terminal pins protruding into said hood portion of said connector housing, and another end of said contact terminals comprising insulation displacing plates protruding into said terminating portion; and a strain relief including an elongate rectangular collar conforming to the hood portion of said connector housing and insertable thereon for seating said strain relief on said lip, a pair of elongate gull-wing flaps integral to said collar and pivotally joined thereto along compliant seams, said flaps extending from opposite sides of said connector housing to a substantially perpendicular bend inward, and further from said inward bend to a pair of engagable interlocking edges having a plurality of cooperating latch mechanisms along their length for locking said flaps in engagement;

whereby said gull-wing flaps of said strain relief may be pivoted around the terminating portion of said connector housing to enclose said connector housing, and said edges may be interlocked at said latch mechanisms with said ribbon cable compressed therebetween to protect against strain imparted to said ribbon cable.

* * * * *